US010583960B2

(12) United States Patent
Erie et al.

(10) Patent No.: US 10,583,960 B2
(45) Date of Patent: Mar. 10, 2020

(54) SELECTIVELY HEIGHT ADJUSTABLE SHIPPING PALLET

(71) Applicant: International Business Machines Corporation, Armonk, NY (US)

(72) Inventors: Clinton Erie, Adams, MN (US); Jason Lee, Oronoco, MN (US); Michael MacPherson, Elgin, MN (US); Ryan Paske, Rochester, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/015,870

(22) Filed: Jun. 22, 2018

(65) Prior Publication Data

US 2019/0389621 A1 Dec. 26, 2019

(51) Int. Cl.
*B65D 19/38* (2006.01)
*B65D 19/00* (2006.01)

(52) U.S. Cl.
CPC ..... *B65D 19/38* (2013.01); *B65D 19/0004* (2013.01); *B65D 2519/00273* (2013.01); *B65D 2519/00368* (2013.01); *B65D 2519/00796* (2013.01); *B65D 2519/00805* (2013.01)

(58) Field of Classification Search
CPC ..... B65D 19/38; B65D 19/00
USPC ..... 108/54.1, 57.12, 51.11
See application file for complete search history.

(56) References Cited

U.S. PATENT DOCUMENTS 1,812,861 A * 7/1931 Chase ..... B62B 3/0625 108/136
3,015,470 A * 1/1962 Patchen ..... B66F 3/35 108/57.12
3,267,882 A * 8/1966 Rapson ..... B60V 3/02 108/51.11

(Continued)

FOREIGN PATENT DOCUMENTS

WO 2008019691 A1 2/2008
WO 2010011167 A1 1/2010
WO 2014043525 A2 3/2014

OTHER PUBLICATIONS

Gallagher, Sean, et al.,; "The effects of operator position, pallet orientation, and palletizing condition on low back loads in manual bag palletizing operations", International Journal of Industrial Ergonomics 47.8 (2015): 4e92.

*Primary Examiner* — Jose V Chen
(74) *Attorney, Agent, or Firm* — Cantor Colburn LLP; Tihon Poltavets

(57) ABSTRACT

A selectively height adjustable pallet including a first member having a first outer surface and a first inner surface, a second member having a second outer surface and a second inner surface, and a plurality of selectively adjustable supports arranged between the first member and the second member. The selectively adjustable supports being operable to establish a first distance between the first inner surface and the second inner surface in a first configuration and a second distance, distinct from the first distance between the first inner surface and the second inner surface in a second configuration. At least one cross member is selectively arranged between the first inner surface and the second inner surface when the plurality of adjustable supports are in one of the first configuration and the second configuration.

20 Claims, 5 Drawing Sheets

(56) References Cited

U.S. PATENT DOCUMENTS 3,351,027 A * 11/1967 Ellard, Jr. ..... B65D 19/0028 108/57.12
3,440,976 A * 4/1969 Burne ..... B65D 19/00 108/51.11
3,523,507 A * 8/1970 Dubin ..... B65D 19/40 108/57.12
3,807,581 A 4/1974 Nichols
4,722,505 A * 2/1988 Kaiser ..... G11B 33/08 248/561
5,881,507 A * 3/1999 Yoo ..... E04H 9/022 248/565
6,112,672 A * 9/2000 Heil ..... B65D 19/0026 108/54.1
6,418,862 B1 * 7/2002 Heil ..... B65D 19/0028 108/57.12
6,598,545 B2 * 7/2003 Ryaboy ..... G01M 11/04 108/136
7,779,765 B2 * 8/2010 Donnell, Jr. ..... B65D 19/0016 108/56.1
7,891,675 B2 * 2/2011 Dobra ..... B62B 5/049 108/54.1
8,720,350 B2 * 5/2014 Bush ..... B65D 19/0073 108/57.12
9,227,757 B1 * 1/2016 Green ..... B65D 19/0095
9,284,107 B2 * 3/2016 Schultz ..... F16F 15/067
9,932,144 B2 * 4/2018 Embleton ..... B65D 19/0012
10,059,487 B2 * 8/2018 Sun ..... B65D 81/02
2001/0050035 A1 * 12/2001 Mahnken ..... B64D 1/14 108/57.12
2003/0154889 A1 * 8/2003 Sedge ..... B65D 19/12 108/54.1
2007/0221102 A1 * 9/2007 Reinhall ..... B65D 19/0073 108/57.12
2007/0266494 A1 11/2007 DeLuca
2010/0000163 A1 * 1/2010 Tsai ..... E04F 15/02405 52/126.6
2010/0212982 A1 8/2010 Lin
2010/0294175 A1 * 11/2010 Cummins ..... F16F 9/54 108/57.12
2012/0000399 A1 * 1/2012 Aden ..... B65D 19/0026 108/51.11
2012/0025027 A1 2/2012 Yandle
2013/0011230 A1 1/2013 Barry
2014/0102339 A1 * 4/2014 Leen ..... B65D 19/0095 108/56.3
2014/0186149 A1 7/2014 Campbell
2017/0107013 A1 * 4/2017 Yoshifusa ..... B65D 19/0069

* cited by examiner

SELECTIVELY HEIGHT ADJUSTABLE SHIPPING PALLET

BACKGROUND

The present invention relates to the art of shipping pallets and, more particularly, to a selectively height adjustable shipping pallet.

Shipping pallets are typically formed from wood, plastic and/or other materials and are used to support goods being transported from one location to another. Shipping pallets have a standard height that may accommodate lifting forks. The lifting forks may form part of a fork lift, a pallet jack or the like. The lifting forks raise the pallet and goods stored thereon, for movement around a warehouse, onto or off of a transport vehicle, or the like.

Occasionally, large items, both in mass and in height, may be transported on a pallet. Positioning these items onto the pallet typically involves the use of a pallet jack, forklift or the like. In some instances, the large item may be on wheels and a ramp is employed to load or off load from the pallet. Wheeling a large item off of a pallet presents various challenges and typically requires the attendance and help of multiple individuals. Accordingly, the industry would be receptive to a system that would reduce the various challenges as well as the number of individuals needed to off load a large item from a pallet.

SUMMARY

Embodiments of the present invention are directed to a selectively height adjustable pallet including a first member having a first outer surface and a first inner surface, a second member having a second outer surface and a second inner surface, and a plurality of selectively adjustable supports arranged between the first member and the second member. The selectively adjustable supports being operable to establish a first distance between the first inner surface and the second inner surface in a first configuration and a second distance, distinct from the first distance between the first inner surface and the second inner surface in a second configuration. At least one cross member is selectively arranged between the first inner surface and the second inner surface when the plurality of adjustable supports are in one of the first configuration and the second configuration.

Embodiments of the invention are also directed to a method of transporting a good on a selectively height adjustable pallet comprising, positioning a first member of the selectively height adjustable pallet in a first configuration relative to a second member of the selectively height adjustable pallet, positioning the good on the first member, adjusting a plurality of selectively adjustable supports to raise the first member to a second configuration relative to the second member, and installing at least one cross member between the first member and the second member to maintain the first member in the second configuration.

DETAILED DESCRIPTION

Figure 1:
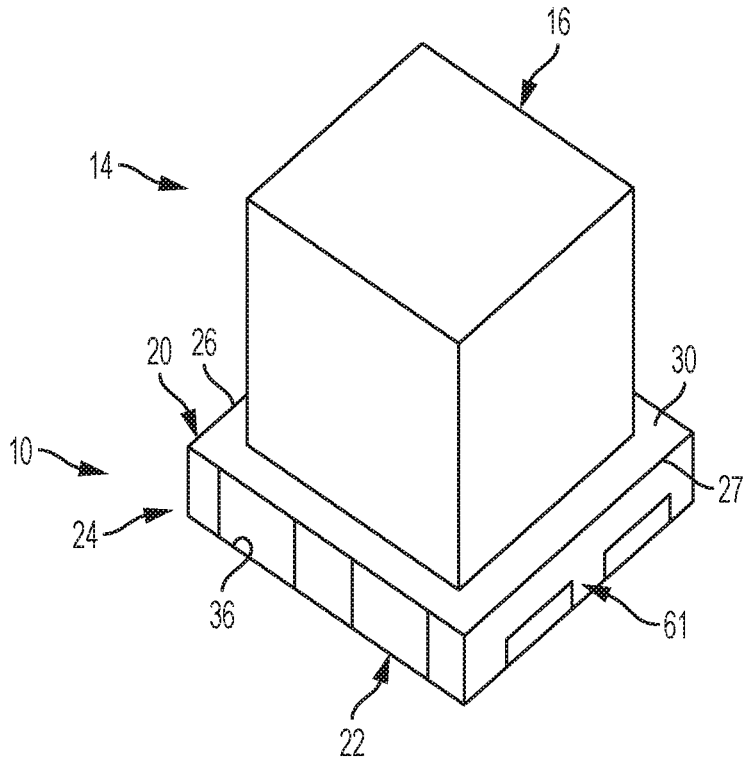
FIG. 1 depicts a selectively height adjustable pallet, in accordance with an exemplary embodiment.

With initial reference to FIG. 1, a selectively height adjustable pallet, in accordance with an exemplary embodiment, is indicated generally at 10. Selectively height adjustable pallet 10 supports a good 14 that may take the form of a server rack 16 and includes a first member 20 connected to a second member 22 through a plurality of selectively adjustable supports, one of which is indicated at 24. At this point, it should be understood that while described as a server rack, good 14 may take on a variety of forms including goods that are heavy and supported by wheels. Selectively height adjustable pallet 10 is also shown to include a first side 26 and a second side 27. As will be detailed herein, selectively adjustable supports 24 are operated to shift first member 20 relative to second member 22 to ease loading and unloading of goods, particularly large goods, that are not only heavy, but also tall. By shifting upper member 20 relative to lower member 22 less manpower may be needed to load and unload, for example, good 14.

Figure 2:
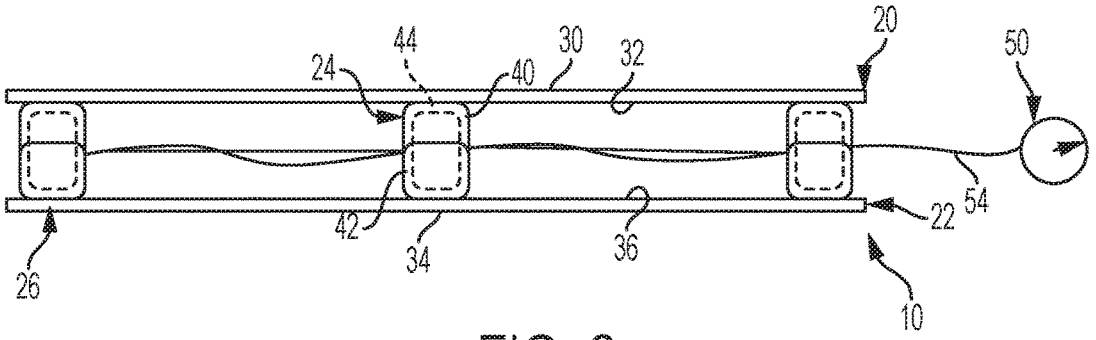
FIG. 2 depicts a selectively height adjustable pallet, in accordance with an exemplary aspect, shown in a first or raised configuration.
Figure 3:
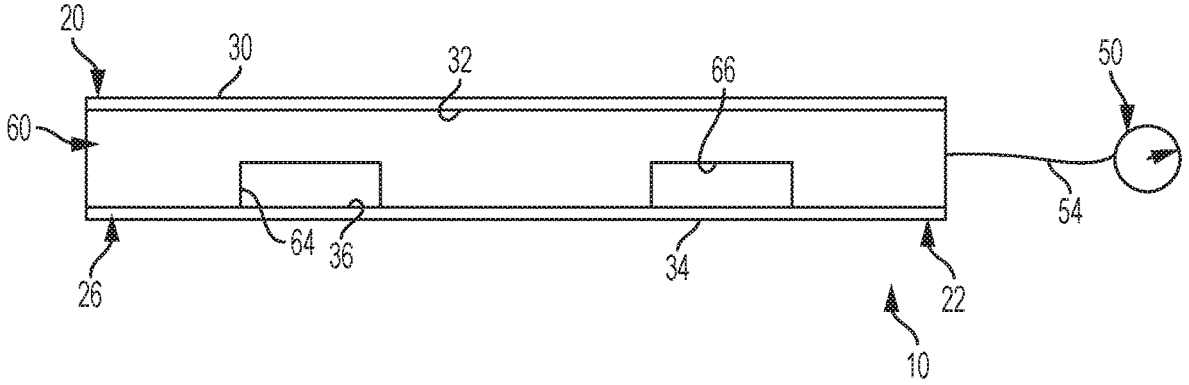
FIG. 3 depicts the selectively height adjustable pallet of FIG. 2 shown with a cross member installed.

Referring to FIGS. 2-3 first member 20 includes a first outer surface 30 and a first inner surface 32. Second member 22 includes a second outer surface 34 and a second inner surface 36. In accordance with an exemplary aspect, each of the plurality of selectively adjustable supports 24 includes a first element 40 and a second element 42 that cooperates with first element 40. An inflatable bladder 44 may be arranged in one, another, or both of first and second elements 40 and 42. Inflatable bladder 44 may be selectively inflated by a pump (not shown) to shift first element 40 relative to second element 42. A pressure gauge 50 may be connected to each selectively adjustable support 24 through a gauge line 54. Pressure gauge 50 may sense and display a fluid pressure in each inflatable bladder 44.

In further accordance with an exemplary aspect depicted in FIG. 3, a first cross member 60 may be arranged between first and second members 20 and 22 at first side 26. A second cross member 61 (FIG. 1) may be arranged between first and second members 20 and 22 at second side 27. As shown in FIG. 3, first cross-member 60 includes a first fork receiving pocket 64 and a second fork receiving pocket 66. Second cross member 62 likewise includes first and second fork receiving pockets (not separately labeled). First and second fork receiving pockets 64 and 66 may be receptive of loading forks (not shown) of a pallet jack, fork lift or the like (also not shown) that may be used to lift and maneuver selectively height adjustable pallet 10.

Figure 4:
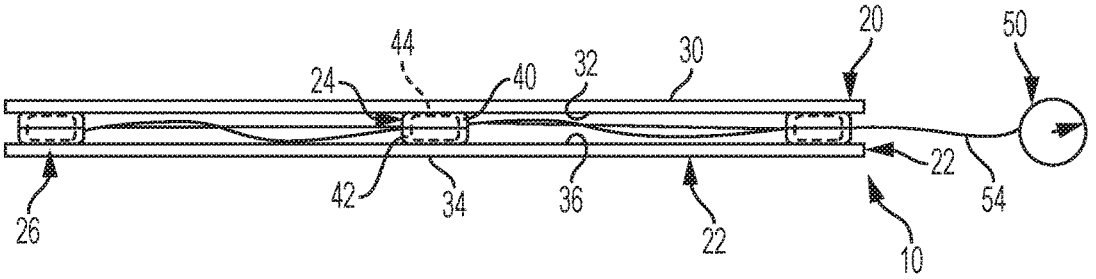
FIG. 4 depicts the selectively height adjustable pallet of FIG. 2 in a second or lowered configuration.

In an embodiment, selectively height adjustable pallet 10 may be arranged in a first configuration, such as shown in FIG. 4, wherein selectively adjustable supports 24 are lowered such that first member 20 is positioned adjacent second member 22. In this configuration, good 14 may be easily loaded onto or off from first member 20. Once loaded, inflatable bladders 44 may be filled with a fluid, such as air, causing first element 40 to shift relative to second element 42 raising first member 20 relative to second member 22 thereby transitioning selectively height adjustable pallet 10 in a second configuration such as shown in FIG. 2. In this second configuration, first and second cross members 60 and 61 may be installed to secure first member 20 in the second configuration for shipment. At this point, inflatable bladders 44 may (or may not) be deflated.

Figure 5:
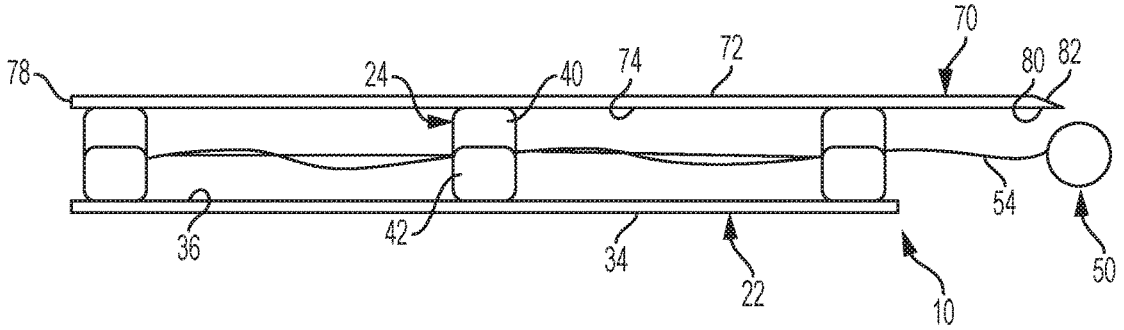
FIG. 5 depicts a selectively height adjustable pallet, in accordance with another exemplary aspect, shown in the first configuration.
Figure 6:
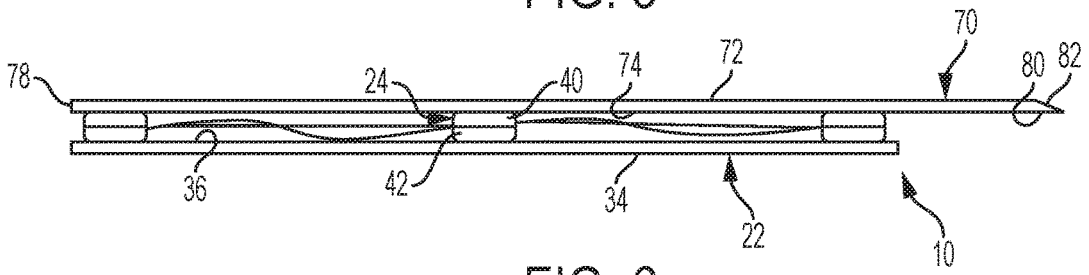
FIG. 6 depicts the selectively height adjustable pallet of FIG. 5, shown in the second configuration.
Figure 7:
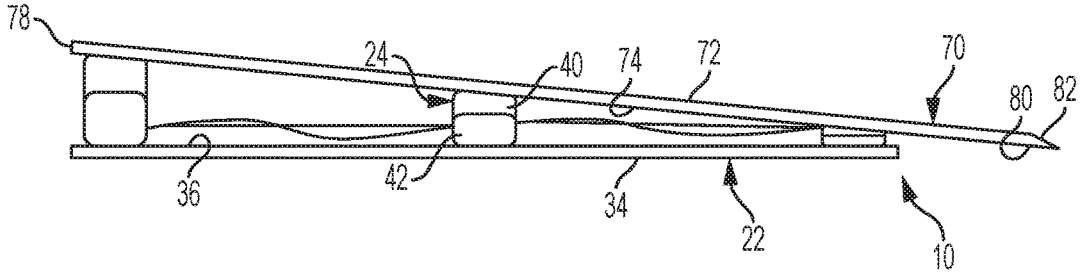
FIG. 7 depicts the selectively height adjustable pallet of FIG. 5 shown in a third or angled configuration.

Reference will now follow to FIGS. 5-7, wherein like reference numbers represent corresponding parts in the respective views, in describing a first member 70 in accordance with another aspect of an exemplary embodiment. First member 70 includes a first outer surface 72 and a first inner surface 74. First member 70 also includes a first end 78 and a second, cantilevered end 80 having an angled edge 82. With this configuration, first member 70 may be arranged in the first configuration (FIG. 5), the second configuration (FIG. 6) and a third configuration (FIG. 7).

In an exemplary aspect, in the third configuration, a portion of the plurality of selectively adjustable supports 24 may be arranged in the first configuration, another portion of selectively adjustable supports 24 are placed in the second configuration, and yet others of the selectively adjustable supports 24 are arranged in a position between the first configuration and the second configuration. In this manner, first outer surface 72 is angled relative to second member 22 easing the loading and/or unloading of goods.

Figure 8:
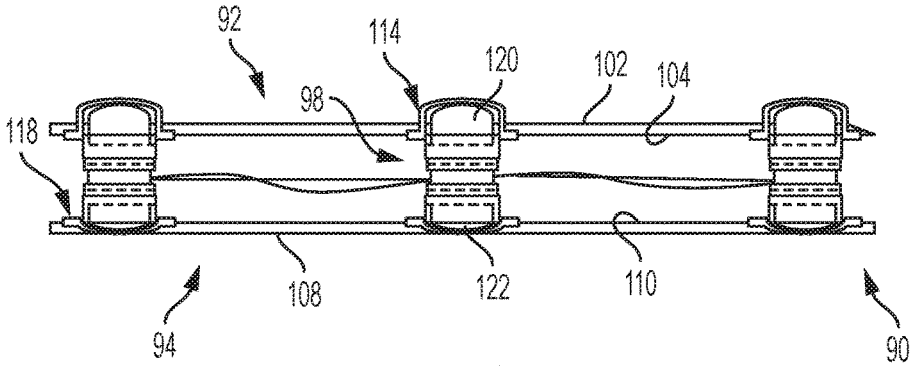
FIG. 8 depicts a selectively height adjustable pallet, in accordance with yet another exemplary aspect, shown in the first configuration.
Figure 9:
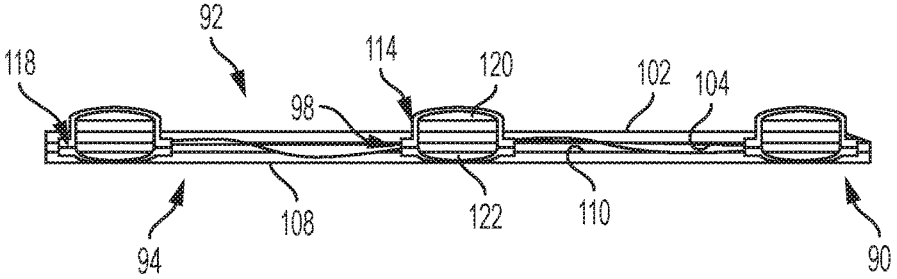
FIG. 9 depicts the selectively height adjustable pallet of FIG. 8, shown in the second configuration.

Reference will now follow to FIGS. 8-9 in describing a selectively height adjustable pallet 90 in accordance with another aspect of an exemplary embodiment. Selectively height adjustable pallet 90 includes a first member 92 and a second member 94 connected by a plurality of selectively adjustable supports 98. First member 92 includes a first outer surface 102 and a first inner surface 104. Second member 94 includes a second outer surface 108 and a second inner surface 110.

In an exemplary embodiment, first member 92 includes a first plurality of support receiving members 114 and second member 94 includes a second plurality of support receiving members 118. First plurality of support receiving members 114 extend through first member 92 and project proudly of first outer surface 102. Second plurality of support receiving members 118 extend into second inner surface 110 of second member 94.

In the embodiment shown, first plurality of support receiving member 114 and second plurality of support receiving members 118 provide additional space for receiving a first element 120 and a second element 122 of each selectively adjustable support 98. In this manner, first member 92 may be lowered closer to second member 94 to further ease loading and unloading of goods from selectively height adjustable pallet 90.

Figure 10:
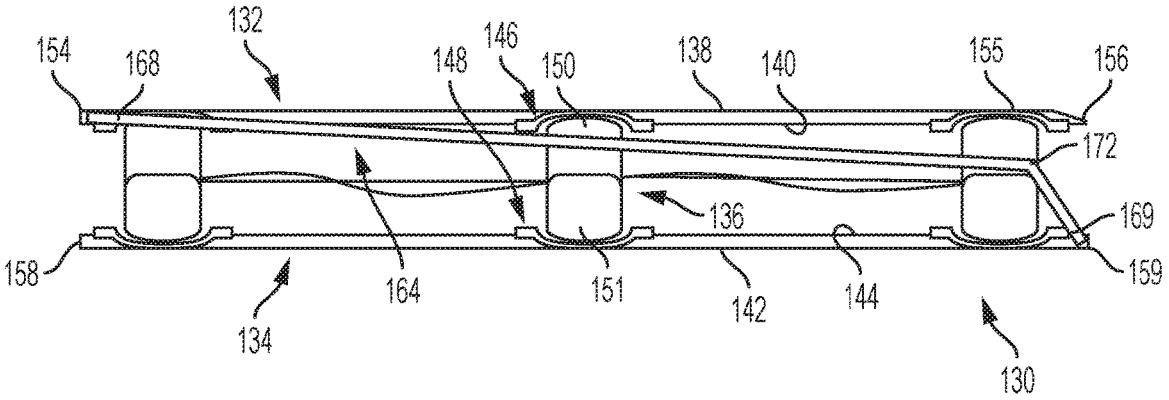
FIG. 10 depicts a selectively height adjustable pallet, in accordance with yet another exemplary aspect, shown in the first configuration.
Figure 11:
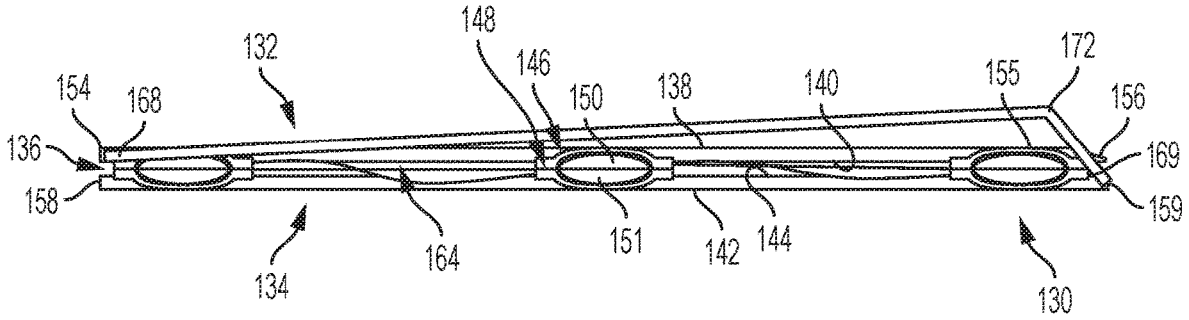
FIG. 11 depicts the selectively height adjustable pallet of FIG. 10 shown in the second configuration.

Reference will now follow to FIGS. 10-11 in describing a selectively height adjustable pallet 130 in accordance with yet another exemplary aspect. Selectively height adjustable pallet 130 includes a first member 132 and a second member 134 connected through a plurality of selectively adjustable supports, one of which is indicated at 136. First member 132 includes a first outer surface 138 and a first inner surface 140. Second member 134 includes a second outer surface 142 and a second inner surface 144.

A first plurality of support receiving members 146 is arranged in first inner surface 140. A second plurality of support receiving members 148 is formed in second inner surface 144. First plurality of support receiving members 146 is receptive of a first element 150 of each of the plurality of selectively adjustable supports 136. Second plurality of support receiving members 148 is receptive of a second element 151 of each of the plurality of selectively adjustable supports 136. In a manner similar to that discussed herein, first and second plurality of support receiving members 146 and 148 provide additional space to accommodate portions of the plurality of selectively adjustable supports 136 allowing first member 132 to be closer to second member 134.

In an embodiment, first member 132 includes a first end section 154 and a second, opposing end section 155 having an angled edge 156. Second member 134 includes a first end portion 158 and a second, opposing end portion 159. A linkage 164 connects first member 132 to second member 134. Another linkage (not shown) may be arranged on an opposing side (also not shown) of selectively height adjustable pallet 130. Linkage 164 includes a first end 168 connected to first end section 154 of first member 132, a second end 169 connected to second end portion 159 of second member 134 and a bend portion 172. Linkage 164 promotes lateral stability of selectively height adjustable pallet 130 when transitioning between the first configuration and the second configuration.

Figure 14:
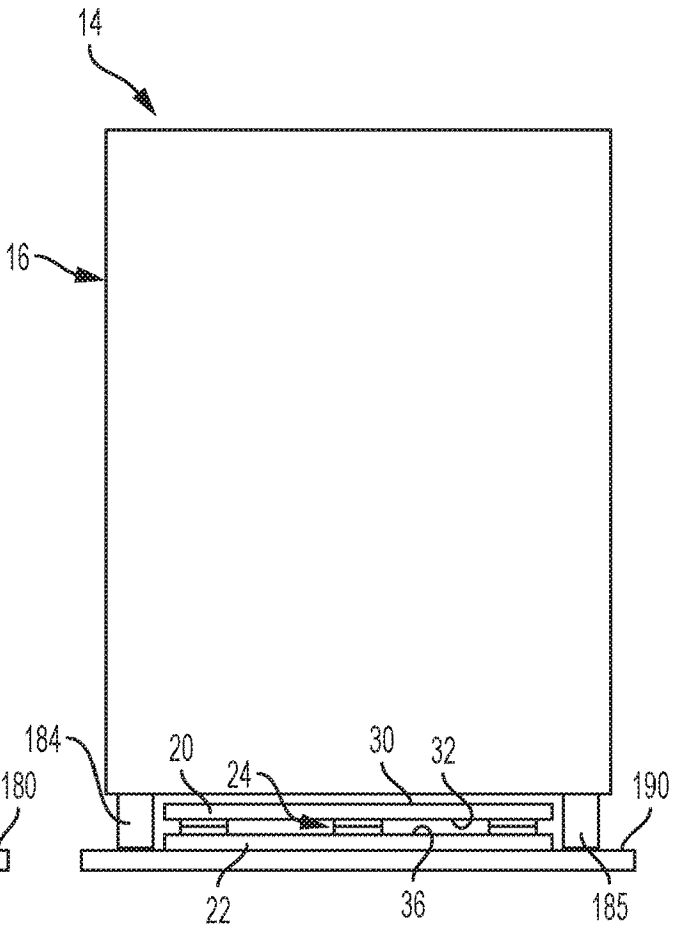
FIG. 14 depicts the selectively height adjustable pallet of FIG. 12 in the second configuration after the good has been transported to a new location, in accordance with an exemplary aspect.
Figure 13:
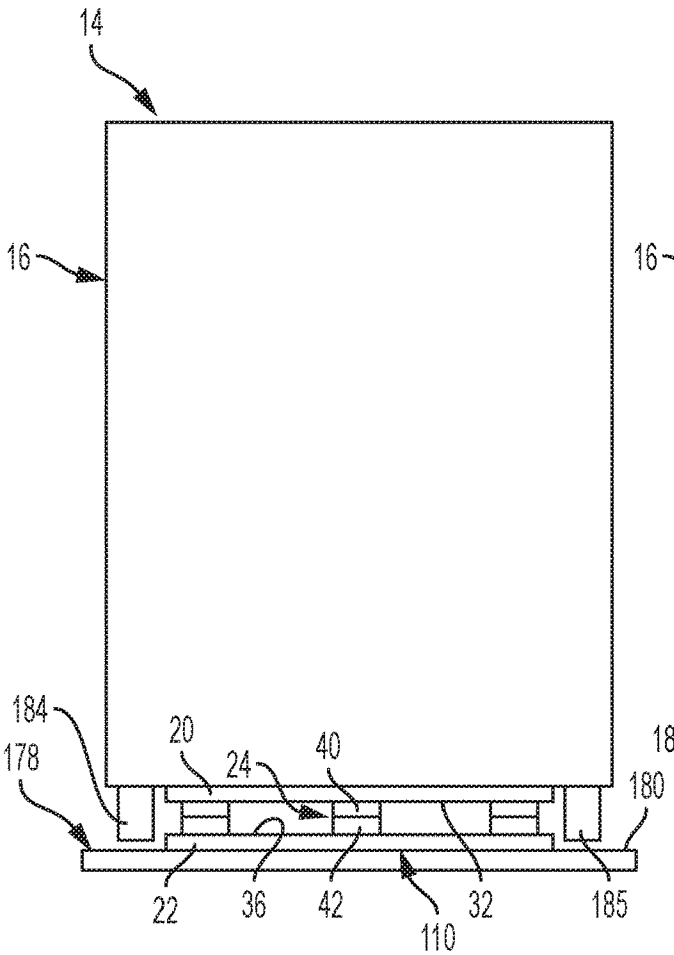
FIG. 13 depicts the selectively height adjustable pallet of FIG. 12 in the first configuration preparing for transport of the good, in accordance with an exemplary aspect.
Figure 12:
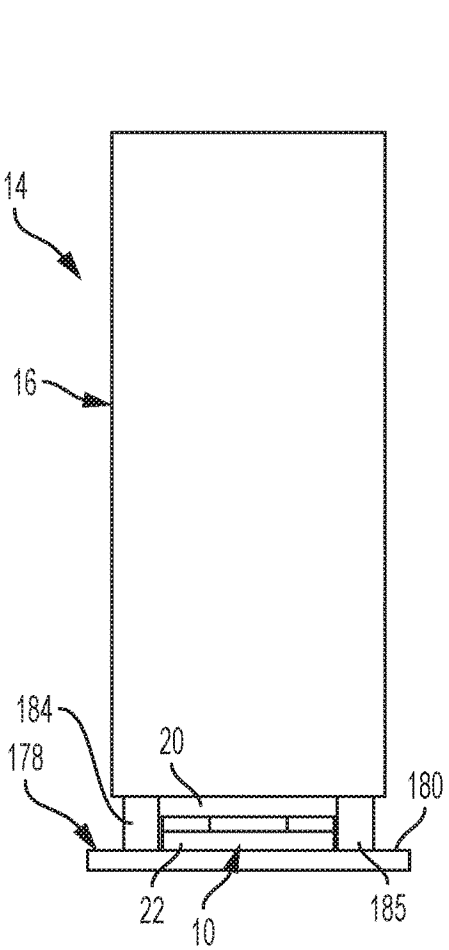
FIG. 12 depicts a selectively height adjustable pallet in the second configuration installed under a good to be transported, in accordance with an exemplary aspect.

Reference will now follow to FIGS. 12-14, wherein like reference numbers represent corresponding parts in the respective views in describing a method of using selectively height adjustable pallet 10 in accordance with an exemplary aspect. Selectively height adjustable pallet 10 may be arranged in the second configuration and positioned on a support surface 178 such as a floor 180 beneath good 14. In an embodiment, selectively height adjustable pallet 10 may be arranged between first and second support legs 184 and 185 on good 14. It should be understood that the number and position of support legs may vary.

Selectively height adjustable pallet 10 may then be transitioned to the first configuration whereby first and second support legs 184 and 185 are elevated off of support surface 178. At this point, first and second cross members 60 and 61 may be installed and secured in place with, for example, screws, pins or the like. Once first and second cross members are in place and secured, inflatable bladders 44 may be deflated and good 14 transported to a new location. First and second cross members 60 and 61 may be removed and selectively height adjustable pallet 10 may be shifted back to the second configuration lowering good 14 onto a new support surface 190. At this point, selectively height adjustable pallet 10 may be withdrawn and good 14 positioned at the new location.

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

What is claimed is:

1. A selectively height adjustable pallet comprising:

a first member having a first outer surface and a first inner surface;

a second member having a second outer surface and a second inner surface;

a plurality of selectively adjustable supports arranged between the first member and the second member, the selectively adjustable supports being operable to establish a first distance between the first inner surface and the second inner surface in a first configuration and a second distance, distinct from the first distance between the first inner surface and the second inner surface in a second configuration; and at least one cross member arranged between the first member and the second member, the at least one cross member abutting the first inner surface and the second inner surface when the plurality of adjustable supports are in one of the first configuration and the second configuration thereby supporting the first member relative to the second member.

2. The selectively height adjustable pallet according to claim 1, wherein the at least one cross member defines at least one fork receiving pocket.

3. The selectively height adjustable pallet according to claim 1, wherein the at least one cross member comprises a first cross member arranged between the first inner surface and the second inner surface at a first side of the selectively height adjustable pallet, and a second cross member arranged between the first inner surface and the second inner surface on a second, opposing side of the selectively height adjustable pallet.

4. The selectively height adjustable pallet according to claim 3, wherein each of the first cross member and the second cross member includes at least two fork receiving pockets.

5. The selectively height adjustable pallet according to claim 1, wherein each of the plurality of selectively adjustable supports includes a selectively inflatable bladder.

6. The selectively height adjustable pallet according to claim 5, further comprising: at least one pressure gauge operatively connected to at least one selectively inflatable bladder.

7. The selectively height adjustable pallet according to claim 1, wherein one or more of the selectively adjustable supports are positionable in the first configuration and others of the selectively adjustable supports are positionable in the second configuration such that the first outer surface is angled relative to the second outer surface.

8. The selectively height adjustable pallet according to claim 1, further comprising: a plurality of support receiving members projecting proudly of the first outer surface, each of the plurality of support receiving members being receptive of at least a portion of corresponding ones of the plurality of selectively adjustable supports.

9. The selectively height adjustable pallet according to claim 1, further comprising: at least one linkage extending between the first member and the second member, the at least one linkage maintaining alignment between the first member and the second member when the plurality of selectively adjustable supports transition between the first configuration and the second configuration.

10. The selectively height adjustable pallet according to claim 1, wherein the plurality of selectively adjustable supports connect the first member with the second member.

11. A method of transporting a good on a selectively height adjustable pallet comprising:

positioning a first member of the selectively height adjustable pallet in a first configuration relative to a second member of the selectively height adjustable pallet;

positioning the good on the first member;

adjusting a plurality of selectively adjustable supports to raise the first member to a second configuration relative to the second member; and installing at least one cross member between the first member and the second member to maintain the first member in the second configuration thereby supporting the first member relative to the second member.

12. The method of claim 11, wherein adjusting the plurality of selectively adjustable supports includes inflating a bladder arranged in each of the selectively adjustable supports.

13. The method of claim 11, further comprising: adjusting a portion of the plurality of selectively adjustable supports to shift the first member into a third configuration wherein the first member is angled relative to the second member.

14. The method of claim 13, further comprising: rolling the good off of the first member in the third configuration.

15. The method of claim 11, further comprising: guiding the first member between the first configuration and the second configuration with at least one linkage connecting the first member and the second member.

16. The method of claim 11, further comprising: positioning forks in fork pockets formed in the at least one cross member.

17. The method of claim 11, wherein positioning the good on the first member includes positioning the selectively adjustable pallet between first and second support elements extending from a lower surface of the good.

18. The method of claim 17, wherein adjusting the plurality of selectively adjustable supports includes raising the first member to lift the support elements from a supporting surface.

19. The method of claim 11, further comprising: transporting the good on the selectively height adjustable pallet from one location to another location with the first member fixedly maintained in the second configuration through the at least one cross member.

20. The method of claim 11, further comprising: adjusting the plurality of adjustable supports from the second configuration to the first configuration after installing the at least one cross member.

* * * * *